US006197129B1

(12) United States Patent
Zhu et al.

(10) Patent No.: US 6,197,129 B1
(45) Date of Patent: Mar. 6, 2001

(54) METHOD FOR PRODUCING ULTRAFINE-GRAINED MATERIALS USING REPETITIVE CORRUGATION AND STRAIGHTENING

(75) Inventors: Yuntian T. Zhu, Los Alamos; Terry C. Lowe, Santa Fe; Honggang Jiang; Jianyu Huang, both of Los Alamos, all of NM (US)

(73) Assignee: The United States of America as represented by the United States Department of Energy, Washington, DC (US)

( * ) Notice: Subject to any disclaimer, the term of this patent is extended or adjusted under 35 U.S.C. 154(b) by 0 days.

(21) Appl. No.: 09/564,696

(22) Filed: May 4, 2000

(51) Int. Cl.[7] ..... B21D 1/06; B21D 3/02; B21D 13/04

(52) U.S. Cl. ..... 148/400; 72/379.6; 72/226; 72/227

(58) Field of Search ..... 428/603, 544, 428/606; 148/400, 320, 432, 645, 648, 684, 685; 72/379.6, 379.2, 199, 201, 226, 234, 227

(56) References Cited

U.S. PATENT DOCUMENTS 3,908,431 * 9/1975 Jones et al. ..... 72/364
4,047,417 * 9/1977 Oser et al. ..... 72/379
4,799,974 1/1989 Mahoney et al. ..... 148/12.7 A
4,838,958 * 6/1989 Komatsubara et al. ..... 148/417
5,513,512 5/1996 Segal ..... 72/253.1
5,809,393 * 9/1998 Dunlop et al. ..... 419/61
5,850,755 12/1998 Segal ..... 72/261
5,904,062 * 5/1999 Semiatin et al. ..... 72/253.1

FOREIGN PATENT DOCUMENTS

0012738 * 6/1980 (EP) .

OTHER PUBLICATIONS

Segal, V.M., Reznikov, V.I., Drobyshevskiy, A.E., Kopylov, V.I., "Plastic Working of Metals by Simple Shear," Russian Metallurgy, vol. 1, pp. 99–105, 1981 (No Month).

A Geleji, "Forge Equipment Rolling Mills and Accessories," Akademiai Kiado, Budapest 1967, chapter 6, pp. 352–359 (No Month).

* cited by examiner

*Primary Examiner*—John J. Zimmerman
(74) *Attorney, Agent, or Firm*—Samuel L. Borkowsky; Paul A. Gottlieb

(57) ABSTRACT

A method of refining the grain structure and improving the hardness and strength properties of a metal or metal alloy workpiece is disclosed. The workpiece is subjected to forces that corrugate and then straighten the workpiece. These steps are repeated until an ultrafine-grained product having improved hardness and strength is produced.

25 Claims, 4 Drawing Sheets

METHOD FOR PRODUCING ULTRAFINE-GRAINED MATERIALS USING REPETITIVE CORRUGATION AND STRAIGHTENING

This invention was made with government support under Contract No. W-7405-ENG-36 awarded by the U. S. Department of Energy to The Regents to the University of California. The U. S. Government has certain rights in the invention.

FIELD OF THE INVENTION

The present invention relates generally to ultrafine-grained materials and more particularly, to a method of refining the grain size of a metal or alloy workpiece to an ultra-fine grain size by repetitively corrugating and then straightening the workpiece.

BACKGROUND OF THE INVENTION

The development of materials that are sufficiently strong and large enough for structural applications is an important and challenging problem. Traditionally, metals are preferred for these applications because of their combined strength and ductility. Metals can be made stronger using various methods that refine the grain size of the material from a coarse grain size to an ultrafine grain (UFG) size of a few microns or less.

Although most high-strain deformation processing techniques, such as extrusion, rolling, and drawing, provide materials with refined grain sizes and improved strength, they do not preserve the dimensions of the original workpiece. One or more dimensions of the workpiece are continuously reduced, which not only limits the obtainable strain, but also eventually transforms the workpiece to a product having a final geometry of a plate, foil, or wire, which limits its structural applications.

A recently developed technique known as Equal Channel Angular Extrusion (ECAE) has been used to provide an ultrafine-grained metal, alloy, plastic, or ceramic product from a coarser grained workpiece without significantly changing the dimensions of the workpiece. Briefly, the ECAE method involves pressing a metal workpiece through a die having two channels that are equal in cross-section and that intersect at an angle $\Phi$. During the pressing, the workpiece undergoes severe shear deformation that refines the grain size and improves strength. Thus, the advantage of the ECAE method is the combination of improving the strength of a workpiece by grain refinement while maintaining its dimensions. The ECAE method may also be combined with cold working procedures such as cold rolling to produce refined, elongated grains.

Current limitations of ECAE hinder its cost-effective implementation for high volume production of metal products. Importantly, the length of a workpiece for processing by ECAE is limited by the stroke distance of the ECAE die press used for processing, and the length/diameter ratio is limited because a large length/diameter ratio makes the extrusion unstable. Furthermore, the ECAE method is currently a discontinuous, slow, and labor intensive, which makes the resulting UFG products expensive.

Clearly, a method for refining the grain size of a workpiece without significantly changing its dimensions is highly desirable. Therefore, an object of the present invention is a method for refining the grain size of a workpiece without significantly changing its dimensions.

Another object of the present invention is a method of improving the hardness and strength properties of a workpiece without significantly changing its dimensions.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention as embodied and broadly described herein, the present invention includes a method for producing an ultrafine-grained product from a coarser-grained workpiece. A workpiece having opposing, substantially flat surfaces is bent to produce a corrugated workpiece. The corrugated workpiece is then subjected to forces that substantially restore the original shape of the workpiece but refine the grain size. The corrugation and subsequent straightening steps are repeated until the workpiece is transformed into an ultrafine-grained product having an ultrafine-grain size and improved hardness and strength.

The invention also includes an apparatus that refines the grain structure of a workpiece by first corrugating it and then straightening it. The apparatus may include dies or rollers configured first to corrugate and then to straighten a workpiece.

BRIEF DESCRIPTION OF THE DRAWINGS

The accompanying drawings, which are incorporated in and form a part of the specification, illustrate embodiments of the present invention and, together with the description, serve to explain the principles of the invention.

In the Figures.

DETAILED DESCRIPTION OF THE INVENTION

Briefly, the present invention includes a method of "repetitive corrugation and straightening" (RCS) to produce ultrafine-grained (UFG) materials. Reference will now be made in detail to the present preferred embodiments of the invention, examples of which are illustrated in the accompanying drawings. Similar or identical structure is identified using identical callouts.

Figure 1:
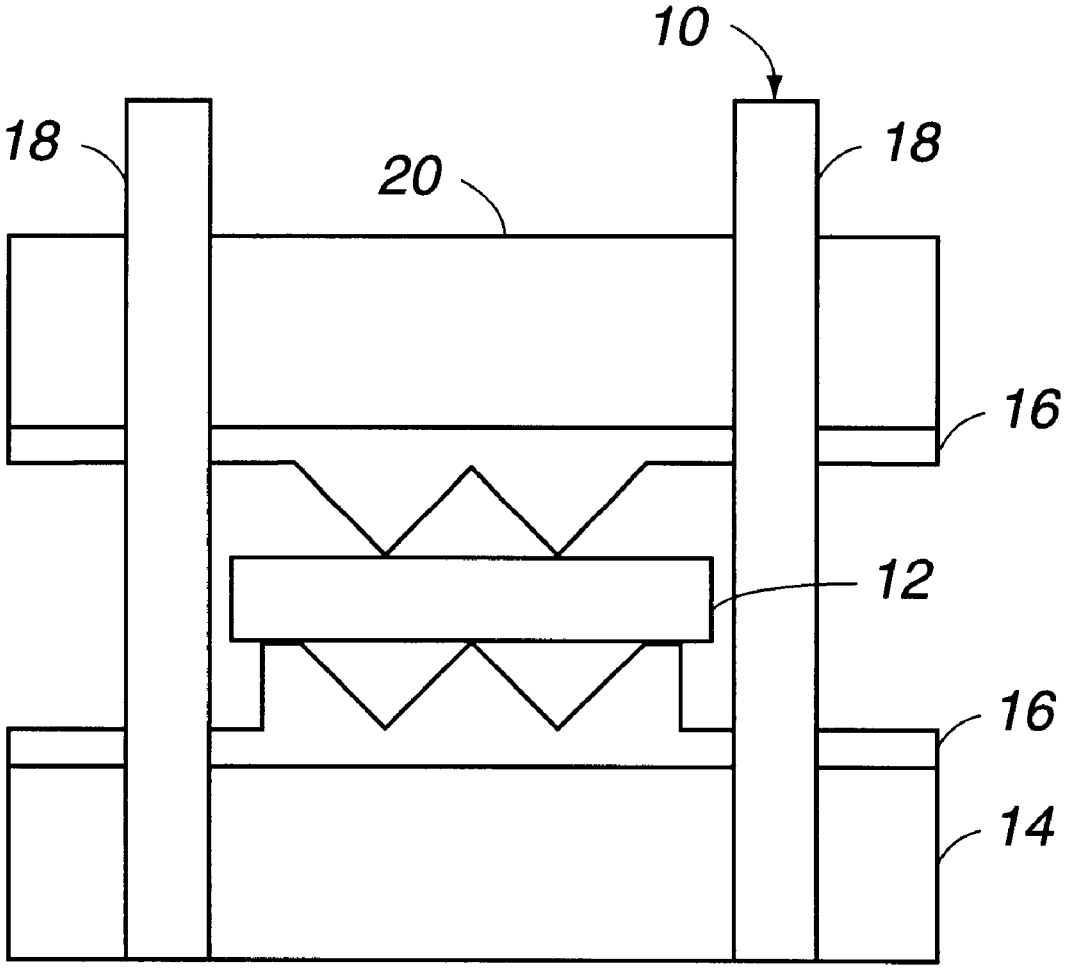
FIG. 1 is a schematic representation of a die and press used for repetitively corrugating and then straightening a workpiece.

FIG. 1 shows an apparatus 10 used to produce an UFG product from a workpiece 12. Apparatus includes a base 14, corrugating die 16 resting upon base 14, and vertical supports 18 that support press 20. Another corrugating die 16 is attached to press 20. After placing workpiece 12 between corrugating dies 16, press 20 applies force to workpiece 12 and to bend it to produce a corrugated workpiece. Corrugating dies 16 are then removed and replaced with flat surfaced dies. The corrugated workpiece is replaced between the flat surfaced dies and press 20 applies force on the corrugated workpiece and straightens it. These steps of sequential corrugation and straightening can be repeated to produce an ultrafine-grained product having improved hardness and strength.

Figure 2:
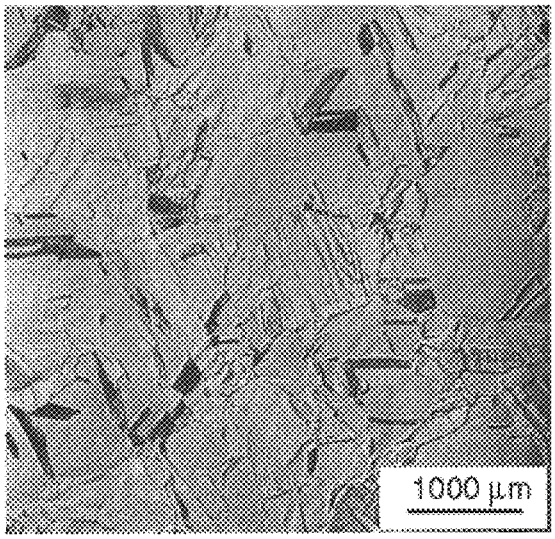
FIG. 2 is an optical micrograph of copper metal annealed at 900° C. for one hour.
Figure 3A:
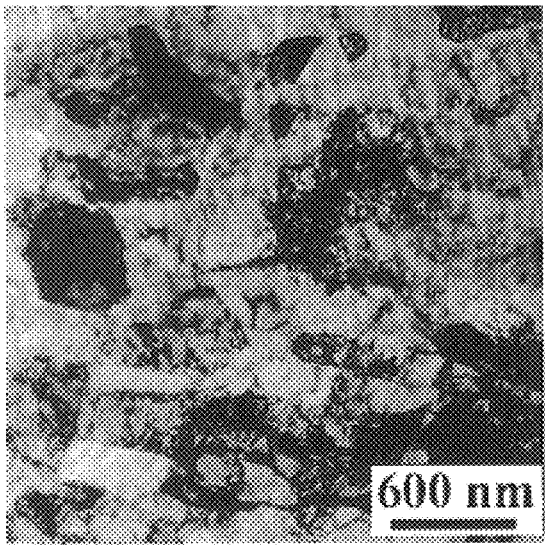
FIG. 3*a* is a transmission electron microscopy (TEM) micrograph of the copper of FIG. 2 after processing according to the method of the present invention.
Figure 3B:
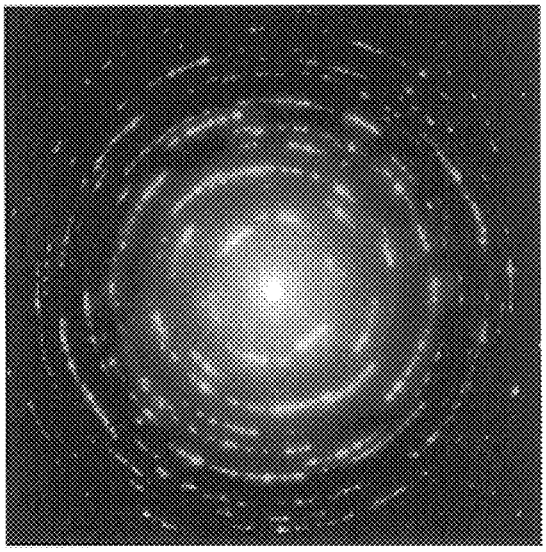
FIG. 3*b* is a selected area diffraction pattern obtained for the copper of FIG. 3*a*.

The following example illustrates the application of the method of the present invention using the apparatus of FIG. 1 to refine the grain size of a copper workpiece. A high purity (99.99%) copper bar having dimensions of about ¼"×¼"×2" was annealed at 900° C. for one hour. FIG. 2 shows an optical micrograph of the copper after annealing. The average grain size of the copper is about 765 microns ($\mu$m), with the largest grain being about 1500 $\mu$m. The annealed bar was lubricated and then deformed by placing the bar lengthwise between corrugated dies and applying a uniform load of about 3 tons for about 10 seconds across the length of the bar. The resulting corrugated bar was placed between flat plates and straightened by applying a similar load. This corrugating-straightening process was repeated ten times. A transmission electron microscopy (TEM) micrograph of the product is shown in FIG. 3*a*. A comparison of FIG. 2 with FIG. 3*a* shows that application of the method of the present invention has reduced the grain size of the bar to an ultrafine-grain size. The average grain size has been refined from 765 $\mu$m to about 480 nanometers (nm). FIG. 3*b* shows the selected area electron diffraction pattern, which confirms the formation of nanocrystalline structures with large grain boundaries.

The microhardness of the ultrafine-grained copper product shown in FIG. 3*a* was measured using a micro-indentor. A load of 300 g was applied to the product and held for 15 seconds. The microhardness of the starting as-annealed copper of FIG. 2 was 678±8 MPa, while the microhardness of the product was 1359±9 MPa, an increase of about 100%. Since the yield strength of metals is usually about one-third of the microhardness, we estimate a yield strength increase also of about 100%.

Figure 4:
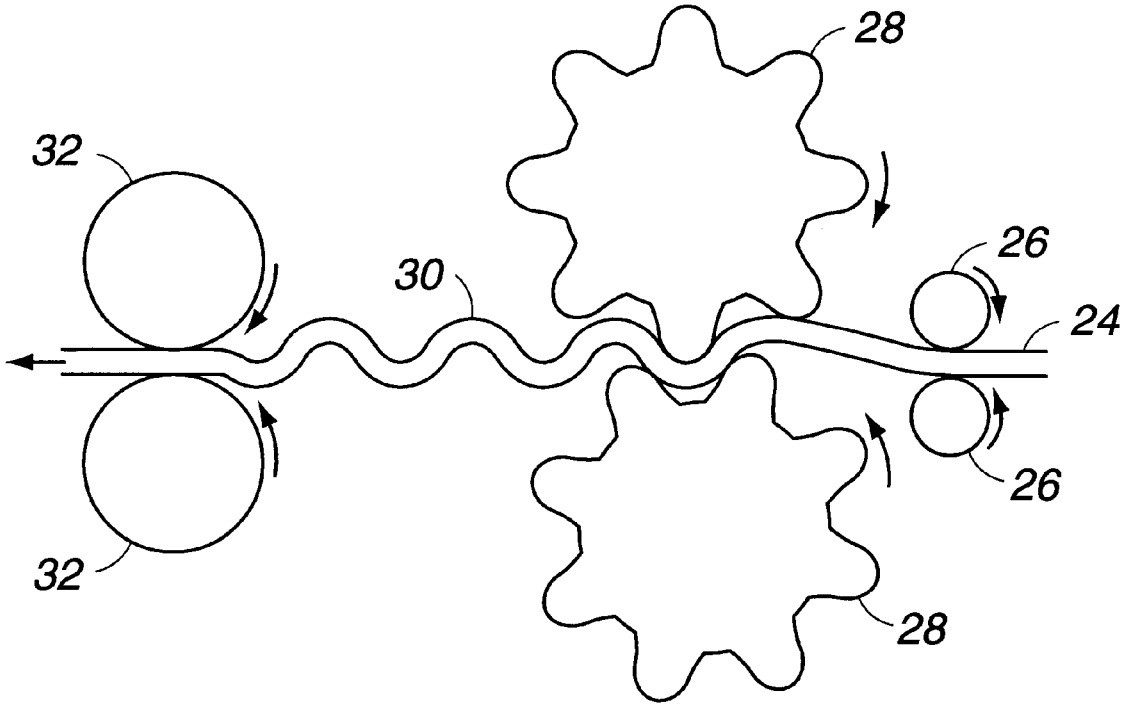
FIG. 4 and FIG. 5 show cross-sectional views of schematic representations of a workpiece undergoing corrugating and straightening according to the present invention.
Figure 5:
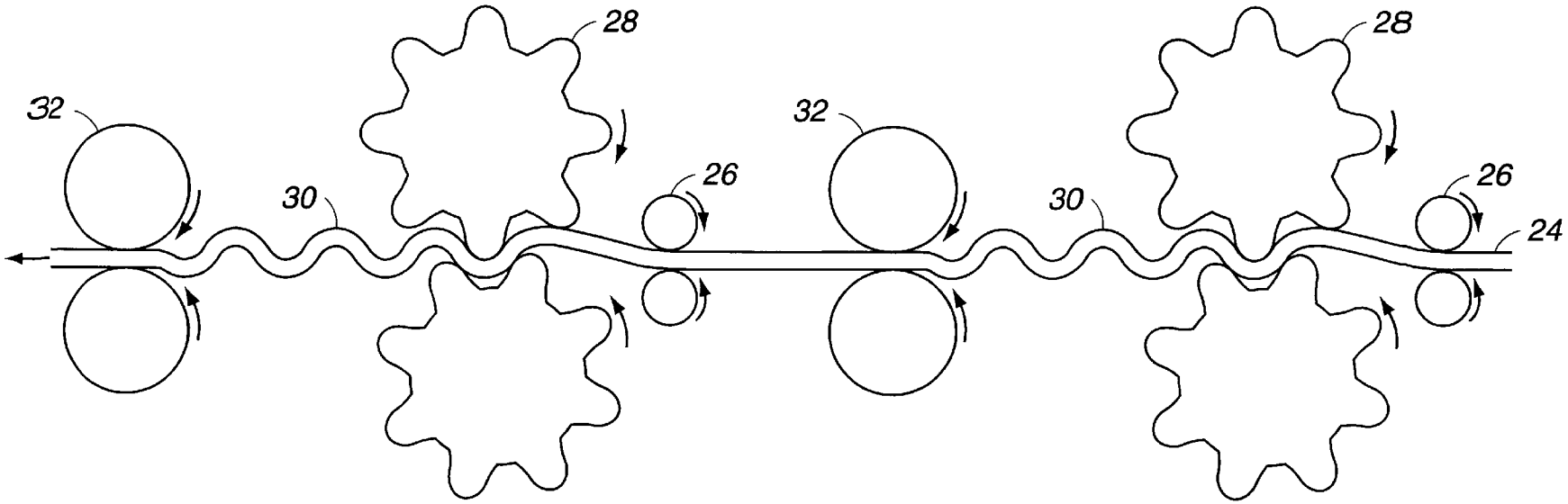

The method of the present invention can be applied to a workpiece using a rolling mill apparatus. Rolling mills are well known in the art (for example, see "Forge Equipment Rolling Mills and Accessories" by A. Geleji, Akademiai Kiado, Budapest, 1967, chapter 6, p. 352–359, which is incorporated by reference herein). FIG. 4 include side views of a schematic representation of rolls of a rolling mill that are configured to corrugate and then straighten a workpiece as they rotate in the same direction. A metal or alloy workpiece 24 passes between directing rollers 26 that direct the workpiece to corrugating rollers 28, which produce a corrugated section 30 as the workpiece passes between them. The corrugation process bends the workpiece with only a slight reduction in the cross-sectional area. The corrugated workpiece continues moving and passes between straightening rollers 32 that straighten it. The straightened workpiece can be repeatedly corrugated and straightened by additional passes through the rollers until an ultrafine-grained product having improved strength, hardness, etc. is obtained. The method of the present invention can be made more continuous by combining additional rollers in sequence as shown in FIG. 5. Obviously, additional rollers that sequentially corrugate and straighten the workpiece can be added to provide an even more continuous process with fewer interruptions involving workpiece removal and reintroduction for further grain refinement and strengthening.

The method of the invention may include rotating the workpiece between subsequent corrugation/straightening passes. For example, a bar-shaped workpiece having a longitudinal axis can first be subjected to a corrugation and straightening pass, then rotated 90 degrees clockwise about its longitudinal axis, then subjected to another corrugating and straightening pass, then rotated 90 clockwise again, then subjected to another pass, etc. A sheet-shaped workpiece can be subjected to a corrugation/straightening pass, then rotated by 90 degrees around the normal sheet direction, then subjected to another pass, then rotated by 90 degrees again, etc.

To make processing easier, lubricants may be applied to the workpiece. In addition, the workpiece may be heated above, or cooled below, ambient temperature prior to, during, or after any corrugation or straightening step.

The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A method for producing an ultrafine-grained product, comprising the steps of:

(a) bending a metal or alloy workpiece having opposing, substantially flat surfaces into a corrugated shape;

(b) applying forces to the corrugated workpiece sufficient to substantially restore the flat surfaces and produce a finer-grained workpiece; and (c) repeating steps (a) and (b) until the workpiece is transformed into an ultrafine-grained product having a refined grain size and improved strength.

2. The method of claim 1, the process further comprising the step of annealing the workpiece after step (a).

3. The method of claim 1, the process further comprising the step of annealing the workpiece after step (b).

4. The method of claim 1, further comprising the step of lubricating the workpiece.

5. The method of claim 1, further comprising the step of rotating the workpiece after performing step (a) and step (b) but before performing step (a) again.

6. The method of claim 1, further comprising the step of warming the workpiece before performing step (a).

7. The method of claim 1, further comprising the step of warming the workpiece before performing step (b).

8. The method of claim 1, further comprising the step of cooling the workpiece before step (a).

9. The method of claim 1, further comprising the step of cooling the workpiece during step (a).

10. the method of claim 1, further comprising the step of cooling the workpiece prior step (b).

11. The method of claim 1, further comprising the step of cooling the workpiece during step (b).

12. An ultrafine-grained metal or alloy product made by the process of:

(a) bending a metal or alloy workpiece having opposing, substantially flat surfaces into a corrugated shape;

(b) applying forces to the corrugated workpiece sufficient to substantially restore the flat surfaces and produce a finer-grained workpiece; and (c) repeating steps (a) and (b) until the workpiece is transformed into an ultrafine-grained product having a desired strength.

13. The product of claim 12, the process further comprising the step of annealing the corrugated workpiece of step (a).

14. The product of claim 12, the process further comprising the step of annealing the straightened workpiece of step (b).

15. The product of claim 12, the process further comprising the step of lubricating the workpiece.

16. The product of claim 12, the process further comprising the step of rotating the workpiece after performing step (a) and step (b) but before performing step (a) again.

17. The product of claim 12, the process further comprising the step of warming the workpiece before and/or during step (a).

18. The product of claim 12, the process further comprising the step of warming the workpiece before and/or during step (b).

19. The product of claim 12, the process further comprising the step of cooling the workpiece before and/or during step (a).

20. The product of claim 12, the process further comprising the step of cooling the workpiece prior to and/or during step (b).

21. An apparatus for refining the grain size of a metal or alloy workpiece, comprising;

(a) means for corrugating the workpiece;

(b) means for straightening the corrugated workpiece; and (c) means for delivering the workpiece from said corrugating means to said straightening means.

22. The apparatus of claim 21, further including means for delivering the straightened workpiece to said corrugating means.

23. The apparatus of claim 21, wherein said corrugating means comprises two rollers positioned such that a straight workpiece can enter between them, said rollers configured to impart deforming forces on the workpiece that result in corrugation of at least a section of the workpiece.

24. The apparatus of claim 21, wherein said straightening means comprises two rollers positioned such that a corrugated workpiece can enter between them, said rollers configured to impart forces that straighten the corrugated section of the workpiece.

25. The apparatus of claim 21, further including means for rotating the workpiece after it has been straightened by said straightening means and before it is corrugated again by said corrugating means.

* * * * *